United States Patent [19]

Kazama et al.

[11] 4,312,633

[45] Jan. 26, 1982

[54] METHOD FOR RECOVERING 1,1,1-TRICHLOROETHANE FROM TEXTILE MATERIALS

[75] Inventors: Ken Kazama, Kamakura; Ikuo Muramoto, Yokohama; Yasunaga Katsumata, Tokyo, all of Japan

[73] Assignee: Asahi-Dow Limited, Tokyo, Japan

[21] Appl. No.: 103,940

[22] Filed: Dec. 14, 1979

[30] Foreign Application Priority Data

Dec. 22, 1978 [JP] Japan ..... 53-157541

[51] Int. Cl.[3] ..... D06L 1/10; B01D 3/36; C07C 17/38

[52] U.S. Cl. ..... 8/142; 203/6; 203/7; 570/262

[58] Field of Search ..... 8/141, 142; 203/6, 50; 570/262

[56] References Cited

U.S. PATENT DOCUMENTS

| | | | |
|---|---|---|---|
| 3,404,943 | 10/1968 | Morris | 8/142 |
| 3,481,685 | 12/1969 | White | 8/142 |
| 3,493,320 | 2/1970 | Case et al. | 8/142 |
| 3,660,248 | 5/1972 | Tsao | 570/262 |
| 3,708,260 | 1/1973 | Marshall | 8/111 |

FOREIGN PATENT DOCUMENTS

| | | |
|---|---|---|
| 773968 | 5/1957 | United Kingdom . |
| 825402 | 12/1959 | United Kingdom . |
| 1130555 | 10/1968 | United Kingdom . |
| 1170783 | 11/1969 | United Kingdom . |
| 1175208 | 12/1969 | United Kingdom . |
| 1273540 | 5/1972 | United Kingdom . |
| 1326261 | 8/1973 | United Kingdom . |

OTHER PUBLICATIONS

Kirk-Othmer, *Encyclopedia of Chemical Technology*, vol. 5, 1965, p. 155.

*Primary Examiner*—Maria Parrish Tungol
*Attorney, Agent, or Firm*—Cushman, Darby & Cushman

[57] ABSTRACT

1,1,1-trichloroethane is recovered in an excellent yield from textile material without deterioration in quality of the textile material by a method in which a textile material is introduced into a hot water bath having a temperature of 64° C. or more and a pH of 4.0 or more, so as to allow 1,1,1-trichloroethane to vaporize together with water, the mixture of vapors of 1,1,1-trichloroethane and water is condensed by cooling it, and then, the condensed 1,1,1-trichloroethane is separated from the condensed water.

7 Claims, No Drawings

METHOD FOR RECOVERING 1,1,1-TRICHLOROETHANE FROM TEXTILE MATERIALS

FIELD OF THE INVENTION

The present invention relates to a method for recovering 1,1,1-trichloroethane from a textile material. More particularly, the present invention relates to a method for removing 1,1,1-trichloroethane from a textile material without deterioration in quality of not only the textile material, but also, the recovered 1,1,1-trichloroethane.

BACKGROUND OF THE INVENTION

It is known that a scouring, dyeing or finishing operation for a textile material, for example, yarn or fabric, can be carried out by using an organic solvent, for example, trichloroethylene, perchloroethylene, 1,1,2-trifluoro-1,2,2-trichloroethane or 1,1,1-trichloroethane, as a medium for a scouring agent, dye, or finishing agent. Also, it is known, in the case of trichloroethylene, perchloroethylene or 1,1,2-trifluoro-1,2,2-trichloroethane, after completing the above-mentioned operation, the residual portion of the organic solvent in the textile material can be recovered by introducing the textile material into a bath containing hot water at a temperature high enough to cause evaporation of the organic solvent, so as to allow the residual organic solvent to be released from the textile material and to be vaporized together with water in the bath. The recovery can be carried out by cooling the vapor mixture of the organic solvent and water generated from the hot water bath, so as to condense it, and then, by separating the condensed organic solvent from the condensed water. The above-mentioned methods are disclosed, for example, in Japanese Patent Application Publication (Kokoku) Nos. 45-1656 and 50-3431, and British Pat. Nos. 773,968 and 825,402.

However, the above-mentioned recovering method has never been applied to 1,1,1-trichloroethane. This is because it has been believed that it is impossible to recover 1,1,1-trichloroethane from a textile material without deterioration in quality of the textile material, when the textile material containing 1,1,1-trichloroethane is brought into contact with hot water. It is known that the contact of 1,1,1-trichloroethane with hot water results in hydrolysis of 1,1,1-trichloroethane at a high hydrolysis rate, which corresponds to about 40 times that of perchloroethylene and about 60 times that of trichloroethylene. The hydrolysis of 1,1,1-trichloroethane results in undesirable formation of hydrochloric acid and acetic acid, which will cause the quality of the textile material to be deteriorated and the vessel of the hot water bath to be corroded.

Also, it has been believed that the hydrolysis causes the yield of the recovered 1,1,1-trichloroethane to be poor. Moreover, it has been believed that the hydrochloric acid and acetic acid which are generated by the hydrolysis of 1,1,1-trichloroethane, are distributed not only in the hot water bath and the water vapor generated from the hot water bath, but also, in the vapor of 1,1,1-trichloroethane released from the textile material. Carrying this concept to its logical conclusion, it has been believed that the hydrochloric acid and acetic acid distributed in the 1,1,1-trichloroethane cause the recovered 1,1,1-trichloroethane to be poor in quality.

Furthermore, it has been believed that, when 1,1,1-trichloroethane is used as a solvent for treating the textile material, the deterioration in quality of the textile material can be prevented only by using a mixture of 1,1,1-trichloroethane with a stabilizer consisting of, for example, at least one member selected from dioxane, methyl butynol and nitromethane, which stabilizer is effective for preventing the hydrolysis of 1,1,1-trichloroethane. However, the stabilizer per se is expensive and it is difficult to recover the stabilizer together with 1,1,1-trichloroethane, because the stabilizer is water-soluble. Therefore, the use of the stabilizer results in an undesirable high cost of the treatment of the textile material with 1,1,1-trichloroethane-containing treating agent.

However, the inventors of the present invention discovered the fact that the deterioration of the textile material and the corrosion of the vessel of the hot water bath can be prevented by maintaining the pH of the hot water bath at a level of 4.0 or more. This discovery causes the treatment of the textile material with the 1,1,1-trichloroethane-containing treating agent without using the stabilizer to be possible. Also, it was discovered by the inventors that the generated hydrochloric acid and acetic acid are mainly distributed in the hot water bath, and therefore, substantially no hydrochloric acid and acetic acid are contained in the recovered 1,1,1-trichloroethane. Accordingly, the recovered 1,1,1-trichloroethane exhibits a good quality.

SUMMARY OF THE INVENTION

An object of the present invention is to provide a method for recovering 1,1,1-trichloroethane from a textile material without deterioration in quality of the textile material and corrosion of the recovering apparatus.

Another object of the present invention is to provide a method for recovering 1,1,1-trichloroethane from a textile material with high efficiency, the recovered 1,1,1-trichloroethane containing substantially no hydrochloric acid and acetic acid.

The above-mentioned objects can be attained by the method of the present invention, which method comprises the steps of:

introducing a textile material containing 1,1,1-trichloroethane into a bath containing hot water having a temperature of the azeotropic point, 64° C., of 1,1,1-trichloroethane and water, or more;

cooling the vapor mixture of 1,1,1-trichloroethane and water generated from the hot water bath, to condense it, and;

separating the condensed 1,1,1-trichloroethane from the condensed water, and which process is characterized in that the pH of the hot water bath is maintained at a level of 4.0 or more.

DETAILED DESCRIPTION OF THE INVENTION

The term "textile material" used herein refers to a material made of staple fibers, multifilaments and/or monofilaments which are insoluble in hot water. The textile material may be in the form of, for example, a mass of loose staple fibers, spun yarn, multifilament yarn, monofilament yarn, thread, rope, cord, knitted fabric, woven fabric, non-woven fabric, net or composite material comprising two or more of the above-mentioned materials. Also, the textile material may be made of any natural and artificial fibers and filaments, for example, cotton, wool, silk, rayon, and polyester, polyamide and polyacrylic fibers or filaments, as long as the fibers or filaments are insoluble in hot water.

In the method of the present invention, a textile material which has been treated with a treating liquid containing 1,1,1-trichloroethane, and therefore, which contains 1,1,1-trichloroethane, is introduced into a bath containing hot water. In this step, the temperature of the hot water is maintained at a level of, at the lowest, the azeotropic point of 1,1,1-trichloroethane and water, that is 64° C., so as to allow the 1,1,1-trichloroethane to be vaporized together with water and to be released from the textile material.

In the above-mentioned step, the contact with the hot water causes a portion of the 1,1,1-trichloroethane to be hydrolyzed, so as to generate hydrochloric acid and acetic acid. Therefore, in order to protect the textile material and the vessel of the hot water bath from action of the hydrochloric acid and acetic acid, it is essential to maintain the pH of the hot water at a level of 4.0 or more, preferably, from 4.0 to 10.0.

The preferable range of the pH of the hot water bath which must be 4.0 or more, is variable depending on the type of the textile material and the type of material from which the vessel of the hot water bath is made. The preferable value of the pH of the hot water bath is in a range of from 4.0 to 8.0 for animal fiber materials, for example, wool and silk materials, in a range of from 4.0 to 9.0 for cellulosic fiber materials, for example, cotton and rayon materials, in a range of from 4.0 to 10.0 for synthetic material polyester fiber materials, and in a range of from 4.0 to 9.0 for polyamide and polyacrylic fiber materials.

When the vessel for containing the hot water bath is made of a metal which is corrodible by acid, for example, iron, copper and zinc, the hot water having a pH of less than 4.0 will cause rapid corrosion of the vessel. This phenomenon will be illustrated by the following experiments.

A flask was charged with 150 ml of water and two pieces of iron strip in such a manner that one piece of the iron strip was completely immersed within the water and the other one piece of iron strip was located above the surface of the water. The pH of the water was adjusted to 3.0 by adding a small amount of hydrochloric acid thereto. The flask was repeatedly heated and cooled in such a manner that every day the flask was heated to a temperature of 75° C. and kept at that temperature for 8 hours, and then, allowed to cool to room temperature and maintained at this temperature for the remaining 16 hours.

The same procedures as those mentioned above were carried out, except that the iron strips were replaced by zinc strips. As a result of the experiment, it was observed that at the stage of 80 hours from the start of the experiments, one piece of iron strip which was immersed in the acid water, and both the two pieces of zinc strip were completely corroded. Also, the other piece of iron strip, which was located above the acid water surface, was partially corroded.

However, when the same procedures as those in the above-mentioned experiment, were carried out, except that the pH of the water was adjusted to 4.0 in place of 3.0, it was found that substantially no corrosion occured on any of the pieces of iron strip and zinc strip. The above-mentioned experiments clearly illustrate that, in order to protect a vessel made of an acid-corrodible metal, the pH of the hot water bath should be maintained at a pH of 4.0 or more.

The operation for maintaining of the pH of the hot water bath at a level of 4.0 or more may be carried out by continuously or intermittently replacing a portion of the hot water which has been in contact with the textile material containing 1,1,1-trichloroethane, with fresh hot water having a pH of more than 4.0, preferably, of about 6.0. In this replacement, the heat of the replaced portion of the hot water is usually also exchanged to the fresh hot water by using a heat-exchanger.

The maintaining operation may also be carried out by continuously or intermittently withdrawing a portion of the hot water which has been in contact with the textile material containing 1,1,1-trichloroethane, from the hot water bath; adjusting the pH of the withdrawn portion of the hot water to a level of more than 4.0, preferably, of about 6.0, and; then, recycling the pH-adjusted portion of the hot water into the hot water bath. The adjusting operation of the pH can be carried out by adding an aqueous solution of an alkali, for example, sodium hydroxide and sodium carbonate, or by bringing the withdrawn portion of the hot water into contact with a solid alkaline material, for example, limestone, or with an ion-exchanger resin.

The amount of the hot water to be replaced with the fresh hot water or to be pH-adjusted, is variable depending upon the type and amount of the textile material, content of 1,1,1-trichloroethane in the textile material, the pH of the fresh hot water or pH-adjusted portion of the hot water and the temperature of the hot water. However, usually, it is preferable that the amount of the portion of the hot water to be replaced or pH-adjusted, corresponds to about 6 to about 60 times the weight of the textile material, when the fresh hot water or pH-adjusted portion of the hot water has a pH of 6.0.

The pH of the fresh hot water or the pH-adjusted portion of the hot water is also variable depending on the desired level of the pH of the hot water bath, the amount of the fresh hot water or the pH-adjusted portion of the hot water, the type and amount of the textile material, the content of 1,1,1-trichloroethane in the textile material and the temperature of the hot water bath. Usually, the pH of the fresh hot water or the pH-adjusted portion of the hot water is preferably in a range of from 4.0 to 10.0.

In the method of the present invention, the temperature of the hot water bath is maintained at the azeotropic point of 1,1,1-trichloroethane and water, that is, 64° C., or more. At the above-mentioned temperature of 64° C. or more, 1,1,1-trichloroethane can be vaporized together with water and released from the textile material. However, in order to promote the vaporization of 1,1,1-trichloroethane, it is preferable that the temperature of the hot water bath be maintained at a level of 70° C. or more. At this temperature of the hot water bath, 1,1,1-trichloroethane can quickly reach a temperature high enough to vaporize and receive a latent energy large enough for vaporization from the hot water bath. However, in order to prevent the deterioration in quality of the textile material, it is preferable that the temperature of the hot water bath be maintained at a level of 90° C. or less. This is because a temperature of the hot water bath higher than 90° C. may sometimes cause the textile material to shrink to a greater extent than is desirable.

In the method of the present invention, it is preferable that the residence time of the textile material in the hot water bath be variable depending on the temperature of the hot water bath, the type and weight of the textile material, and the content of 1,1,1-trichloroethane in the textile material. For example, when a worsted fabric having a weight of 344 g/m$^2$ and containing 1,1,1-trichloroethane in an amount corresponding to 100% of the weight of the worsted fabric is introduced into a hot water bath, in order to reduce the amount of the 1,1,1-trichloroethane in the worsted fabric to a level corresponding to 0.5% of the weight of the worsted fabric, the worsted fabric must be allowed to stay in the hot water bath for 60 seconds when the temperature of the bath is 60° C., and for 8 seconds when the temperature of the bath is 80° C. Even in the case of a thick non-woven fabric having a weight of 500 g/m$^2$, 1,1,1-trichloroethane can be released from the fabric in the same proportion as that mentioned above by treating the fabric in the hot water bath, having a temperature of 90° C., for 90 seconds. Accordingly, it is preferable that the residence time of the textile material in the hot water bath be 20 seconds or more, more preferably, in a range of from 5 to 90 seconds.

The mixture of the vapors of water and 1,1,1-trichloroethane generated from the hot water bath is collected and cooled to a temperature below the azeotropic point, 64° C., for example, from 2° to 30° C., so as to condense it. The collecting and cooling operations can be carried out by any conventioned method. For example, the vapor mixture is introduced into a condenser in which the vapor mixture is cooled and condensed. The condensed 1,1,1-trichloroethane naturally forms a liquid layer located below the layer of the condensed water. The 1,1,1-trichloroethane layer can be easily separated from the water layer by any conventional method.

In the method of the present invention, the hot water bath may contain a surface active agent, for example, detergent, which is effective for cleaning the textile material, and a wetting agent which is effective for wetting the textile material with the hot water.

The method of the present invention can exhibit the following advantages.

1. Since the contact of 1,1,1-trichloroethane with water is carried out at a pH of 4.0 or more of the water and at a relatively low temperature of 64.0° C. or more, preferably, 70° to 90° C., the hydrolysis of 1,1,1-trichloroethane is restricted to a relatively low intensity. This feature results in no deterioration of the textile material and in no corrosion of the vessel of the hot water bath. Also, this feature results in a high efficiency in the recovery of 1,1,1-trichloroethane.

2. Since the latent energy for vaporization of 1,1,1-trichloroethane per unit volume thereof is relatively small, the release of 1,1,1-trichloroethane from the textile material can be completed within a short time. Therefore, the method of the present invention can be continuously carried out at a high speed.

3. Since the azeotropic point of 1,1,1-trichloroethane and water is lower than that of another chlorinated organic solvent, for instance, perchloroethylene or trichloroethylene, and water, the release of 1,1,1-trichloroethane from the textile material can be effected at a relatively low temperature. This feature results in substantially no deterioration in quality of the textile material, for example, wool material, silk material or polyacrylic fiber material.

4. The recovered 1,1,1-trichloroethane contains no hydrochloric acid and acetic acid. Therefore, the recovered 1,1,1-trichloroethane can be directly recycled to a process for treating the textile material, without purification.

5. The hot water bath is effective not only for preventing the attack of the hydrochloric acid and acetic acid on the textile material and the vessel, but also, for removing a water-soluble substance and tinting agent from from the textile material.

6. The amount of 1,1,1-trichloroethane remaining in the textile material after the method of the present invention is applied to the textile material, is very small.

7. The apparatus for carrying out the method of the present invention is simple and small.

8. The method of the present invention can be carried out at low cost.

9. The method of the present invention causes the use of 1,1,1-trichloroethane containing no stabilizer for the treatment of the textile material to be possible.

The following examples illustrate, but do not limit, the present invention.

EXAMPLE 1

A worsted fabric having a weight of 344 g/m$^2$ was scoured by using 1,1,1-trichloroethane and then, squeezed to such an extent that the residual amount of 1,1,1-trichloroethane in the textile material corresponded to 100% of the weight of the worsted fabric. The squeezed worsted fabric was introduced, at a speed of 20 m/min, into a closed vessel, made of a stainless steel and containing a hot water bath, which had a length of 2.4 m, a width of 1.3 m and a depth of 1.0 m. The vessel was provided with a zigzag path for the fabric formed between 8 guide rollers. The entire length of the zigzag path was 6.5 m. Accordingly, the residence time of the fabric in the hot water bath, which had a temperature of 75° C. and a pH of 6.0, was about 20 seconds.

It was observed that the hot water bath was saturated by 700 ppm of 1,1,1-trichloroethane about 30 minutes after the start of the introducing operation for the fabric. Also, it was found that after the above-mentioned saturation occurred, the content of the acid substances increased at a rate of $1.42\times10^{-5}$ g/l per minute in terms of $H^+$ ion.

When the pH of the hot water bath reached 4.0, a portion of the hot water was withdrawn from the hot water bath at a rate of 390 l/min, and flowed through a neutralization bath containing limestone, to adjust the pH of the withdrawn portion of the hot water to 6.0. Thereafter, the temperature of the pH-adjusted portion of the hot water was adjusted to 75° C. and, then, recycled into the hot water bath. By the above-mentioned operations, the pH of the hot water bath was maintained in a range of from 4.0 to 6.0.

The mixture of vapors of 1,1,1-trichloroethane and water was withdrawn from the closed vessel and introduced into a condenser, so as to cool the mixture to a room temperature. The condensed mixture was stored in a vessel, so as to allow the layer of the condensed 1,1,1-trichloroethane to be separated from the layer of the condensed water. The condensed 1,1,1-trichloroethane could be easily separated from the water layer.

The worsted fabric was withdrawn from the hot water bath and squeezed to such an extent that the residual water in the fabric corresponded to 100% of the weight of the fabric. The content of the residual 1,1,1-trichloroethane in the squeezed fabric was 0.52%, based on the weight of the fabric. This content was satisfactory.

The above-mentioned operations were continued for 3 hours. The results of the operations are indicated in Table 1.

TABLE 1

| Item | Amount (kg) | pH |
|---|---|---|
| Entire amount and pH of 1,1,1-trichloroethane introduced into hot water bath | 1980.00 | 6.9 |
| Entire amount and pH of recovered 1,1,1-trichloroethaneethane | 1967.16 | 6.9 |
| Entire amount and pH of recovered water | 81.97 | 4.2 |
| Entire amount of residual 1,1,1-trichloroethane in textile material after recovery | 10.30 | — |
| Amount of 1,1,1-trichloroethane remaining in hot water bath | 2.18 | — |
| Entire amount of hydrolyzed 1,1,1-trichloroethane | 0.36 | |

Table 1 clearly indicates that the recovered 1,1,1-trichloroethane contained no hydrochloric acid and acetic acid. Also, the recovery yield of 1,1,1-trichloroethane was 99.3% by weight. Furthermore, it was surprisingly found that the amount of the hydrolyzed 1,1,1-trichloroethane was only 0.02% of the weight of 1,1,1-trichloroethane introduced into the hot water bath. In addition, no deterioration in the quality of the worsted fabric and no corrosion of the vessel were found.

EXAMPLE 2

The same procedures as those mentioned in Example 1 were carried out, except that the worsted fabric was replaced with a cotton fabric having a weight of 231 g/m$^2$, and the temperature of the hot water bath was 80° C.

Before subjecting the cotton fabric to the above-mentioned procedures, the fabric exhibited substantially no alkali solubility, which had been determined by immersing 1 g of the fabric in 100 ml of a 1 N aqueous solution of sodium hydroxide, at a temperature of 65° C., for one hour, and by measuring loss in weight of the fabric.

After completing the procedures, it was found that 1,1,1-trichloroethane, having a pH of 6.9, was recovered in a yield of 98.5% and the cotton fabric exhibited an alkali solubility of substantially zero. pH-adjusting operation was carried out.

When the pH of the hot water bath reached 3.0, and 2.0, the resultant cotton fabric exhibited an alkali solubility of 3.83% and 4.27%, respectively. These phenomenon indicate that the cotton fabric was considerably damaged by the hot water bath having a pH lower than 4.0.

EXAMPLE 3

The same procedures as those mentioned in Example 1 were carried out, except that the worsted fabric was replaced by a double jersey made of polyacrylic staple fiber yarns and having a weight of 306 g/m$^2$. As a result of the recovery operation, 1,1,1-trichloroethane, having a pH of 6.9, was recovered in a yield of 99.8%. Also, it was found that, the shrinkage in course direction of the double jersey was 2.7%, at a temperature of 75° C. of the hot water bath. However, when the temperature of the hot water bath was changed to 96° C., the shrinkage in the course direction of the double jersey was 10.3%. Accordingly, it is clear that in the case of a polyacrylic fiber double jersey, it is preferable that the temperature of the hot water bath be 75° C., rather than 96° C.

What we claim is:

1. A method for recovering 1,1,1-trichloroethane from a textile material, comprising the steps of:

introducing a textile material containing 1,1,1-trichloroethane into a bath containing hot water having a temperature of the azeotropic point, 64° C., of 1,1,1-trichloroethane and water, or more;

cooling the vapor mixture of 1,1,1-trichloroethane and water generated from said hot water bath, to condense it, and;

separating the condensed 1,1,1-trichloroethane from the condensed water, which method is characterized in that the pH of said hot water bath is maintained at a level of 4.0 or more.

2. A method as claimed in claim 1, wherein the pH of said hot water bath is in a range of from 4.0 to 10.0.

3. A method as claimed in claim 1, wherein the temperature of said hot water bath is in a range of from 70° to 90° C.

4. A method as claimed in claim 1, wherein the residence time of said textile material in said hot water bath is in a range of from 5 to 90 seconds.

5. A method as claimed in claim 1, wherein the pH of said hot water bath is maintained at a level of 4.0 or more by withdrawing a portion of said hot water from said hot water bath, adjusting the pH of said withdrawn portion of said hot water to a level higher than 4.0, and recycling said pH-adjusted portion of said hot water into said hot water bath.

6. A method as claimed in claim 5, wherein the pH-adjusting operation is carried out by bringing said withdrawn portion of said hot water into contact with limestone.

7. A method as claimed in claim 5, wherein said pH-adjusted portion of said hot water has a pH of 6.0 or more.

* * * * *